US010532251B1

(12) United States Patent
Madson et al.

(10) Patent No.: US 10,532,251 B1
(45) Date of Patent: Jan. 14, 2020

(54) GOLF BALL DIMPLE PATTERNS INCLUDING STARS AND STRIPES

(71) Applicant: Acushnet Company, Fairhaven, MA (US)

(72) Inventors: Michael R. Madson, Easton, MA (US); William E. Morgan, Rehoboth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/044,644

(22) Filed: Jul. 25, 2018

(51) Int. Cl.
*A63B 37/00* (2006.01)

(52) U.S. Cl.
CPC ..... *A63B 37/0006* (2013.01); *A63B 37/0009* (2013.01); *A63B 37/0011* (2013.01); *A63B 37/002* (2013.01); *A63B 37/0018* (2013.01); *A63B 37/0019* (2013.01); *A63B 37/0021* (2013.01)

(58) Field of Classification Search
CPC ..... A63B 37/0011; A63B 37/0009; A63B 37/0004; A63B 37/0007; A63B 37/001
USPC ..... 473/383
See application file for complete search history.

(56) References Cited

U.S. PATENT DOCUMENTS

| | | | | |
|---|---|---|---|---|
| D30,378 | S * | 3/1899 | Foulis | D21/708 |
| D44,177 | S * | 6/1913 | Martin | D21/708 |
| D386,548 | S * | 11/1997 | Cullen, III | D21/708 |
| 7,033,285 | B2 | 4/2006 | Sato et al. | |
| D738,972 | S * | 9/2015 | Black | D21/707 |
| 2003/0171167 | A1* | 9/2003 | Kasashima | A63B 37/0004 473/378 |
| 2004/0127306 | A1* | 7/2004 | Sato | A63B 37/0004 473/383 |
| 2005/0090335 | A1* | 4/2005 | Kennedy, III | A63B 37/0004 473/383 |
| 2008/0261725 | A1* | 10/2008 | Olson | A63B 37/0007 473/384 |
| 2012/0088608 | A1* | 4/2012 | Sullivan | A63B 37/0004 473/383 |
| 2014/0200099 | A1* | 7/2014 | Aoyama | A63B 37/0007 473/383 |
| 2017/0189761 | A1* | 7/2017 | Madson | A63B 37/0006 |

* cited by examiner

*Primary Examiner* — John E Simms, Jr.
(74) *Attorney, Agent, or Firm* — Mandi B. Milbank

(57) ABSTRACT

The present invention provides golf balls having a pattern of stellated polygon shaped dimples and grooves on the outer surface thereof.

20 Claims, 8 Drawing Sheets

GOLF BALL DIMPLE PATTERNS INCLUDING STARS AND STRIPES

FIELD OF THE INVENTION

This invention relates to golf balls having a novel dimple pattern that includes stellated polygon shaped dimples and grooves.

BACKGROUND OF THE INVENTION

The pattern of the dimples on the outer surface of a golf ball contributes significantly to the flight characteristics of the ball. Thus, many golf ball manufacturers conduct extensive dimple research, which is often focused on improving the aerodynamic forces on the ball during flight and increasing the distance traveled by the ball.

Dimple patterns also contribute to the aesthetics of a golf ball. Thus, for certain purposes, it may be desirable to provide a golf ball with an aesthetically unique dimple pattern. Thus, various decorative dimple patterns have been introduced. For example, U.S. Pat. No. 7,033,285 to Sato discloses a golf ball surface design including star-shaped ridges.

Despite the many dimple patterns disclosed in the prior art, there has been no disclosure of a golf ball having a dimple pattern as provided by the present invention.

SUMMARY OF THE INVENTION

The present invention is directed to a golf ball having a plurality of dimples and a plurality of grooves on the outer surface thereof. The outer surface of the golf ball can be divided by a plane that passes through the geometric center of the golf ball and divides the outer surface into a first hemisphere and a second hemisphere.

In one embodiment, the first hemisphere comprises at least 40 dimples having a stellated polygon plan shape, and the second hemisphere comprises at least 5 grooves.

In another embodiment, the first hemisphere has an arrangement of dimples and grooves comprising 50 dimples having a stellated polygon plan shape and 6 grooves, and the second hemisphere has an arrangement of dimples and grooves that is substantially identical to the arrangement of the first hemisphere.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Figure 1A:
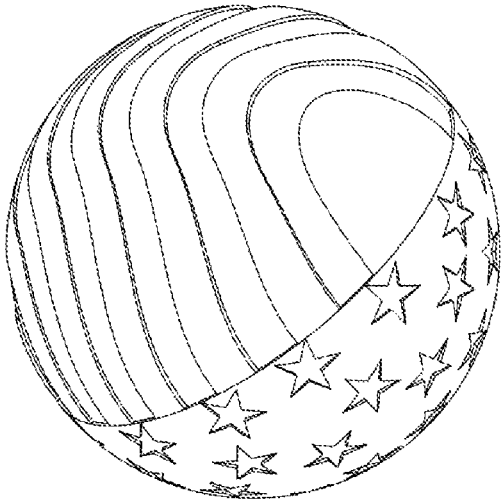
FIGS. 1A-1C illustrate plan views of a golf ball having a dimple pattern according to one embodiment of the present invention.
Figure 1B:
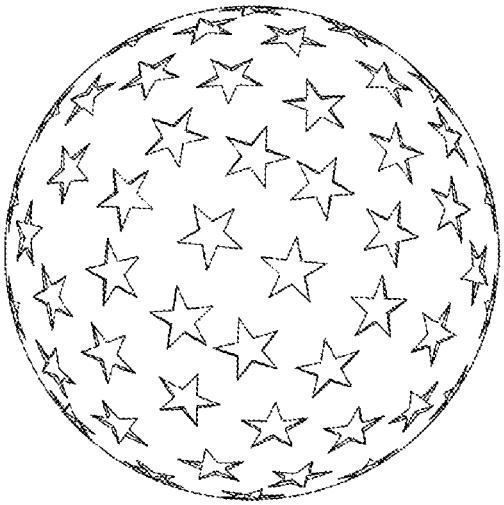
Figure 1C:
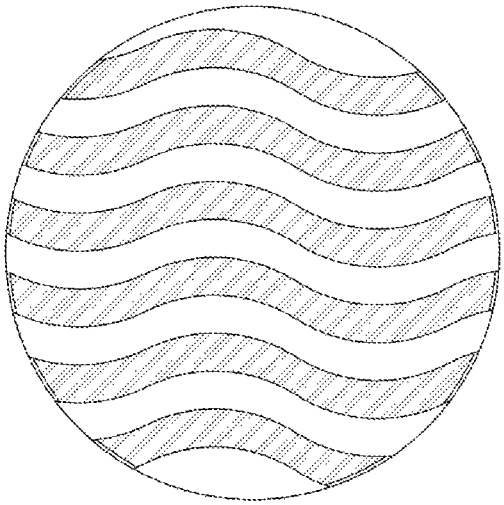
Figure 2A:
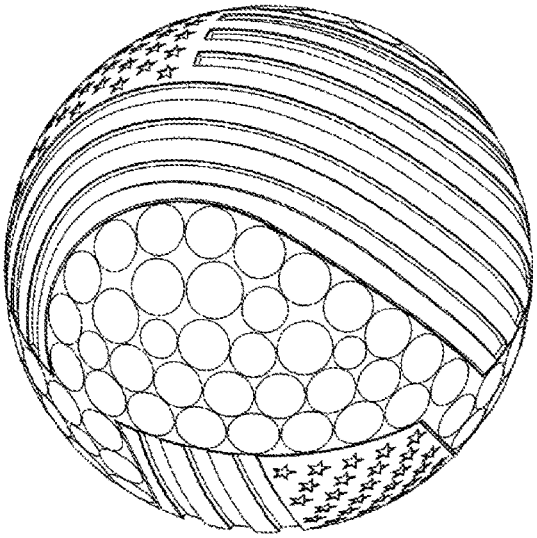
FIG. 2A-2C illustrate plan views of a golf ball having a dimple pattern according to another embodiment of the present invention.
Figure 2B:
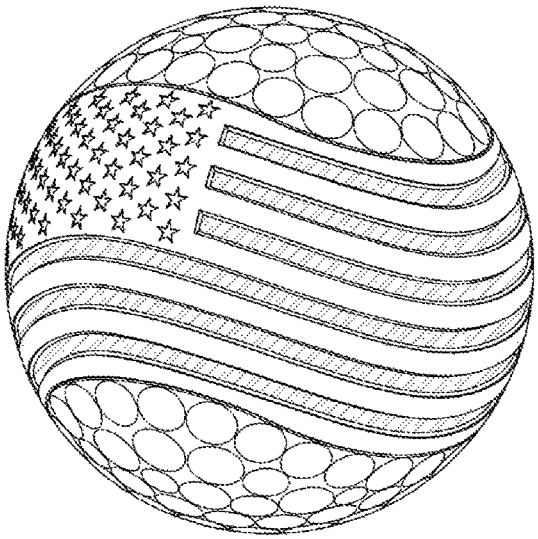
Figure 2C:
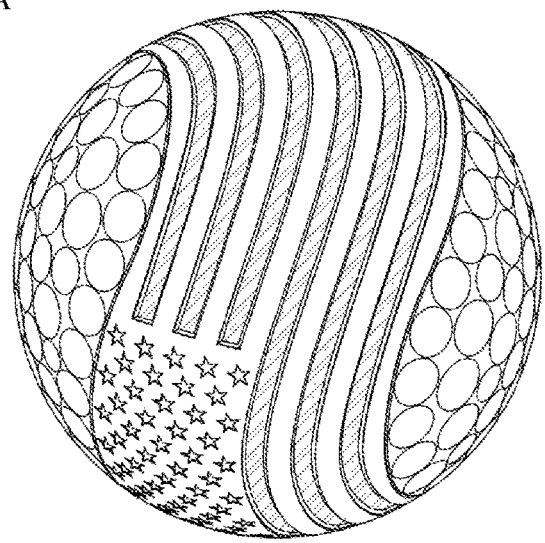

The present invention is directed to golf balls having a novel pattern of stellated polygon shaped dimples and grooves on the outer surface thereof bearing a resemblance to the American flag. The outer surface of the ball is divided by a plane that passes through the geometric center of the golf ball and divides the outer surface into two hemispheres. The dividing plane may be, but is not necessarily, equivalent to the plane that is considered by those of ordinary skill in the art to be the equator of the ball. In one embodiment, as illustrated in FIGS. 1A-1C, one hemisphere of the ball consists of stellated polygon shaped dimples and the other hemisphere consists of grooves. In another embodiment, as illustrated in FIGS. 2A-2C, the ball includes two identical hemispheres, each hemisphere including stellated polygon shaped dimples and grooves.

Stellated Polygon ("Star") Shaped Dimples

Dimple patterns of the present invention include dimples having a plan shape defined by a stellated polygon. Such dimples are referred to herein as "stellated polygon shaped dimples" and "star shaped dimples." In a particular embodiment, star shaped dimples of the present invention have a plan shape defined by a stellated polygon having 4 or 5 or 6 points. In another particular embodiment, star shaped dimples of the present invention have a plan shape defined by a stellated pentagon.

Figure 3:
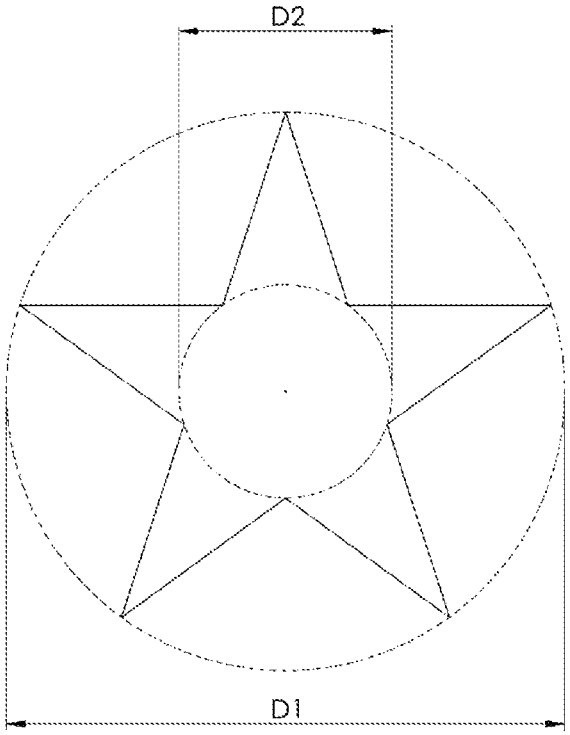
FIG. 3 illustrates a plan view of a stellated polygon shaped dimple according to an embodiment of the present invention.

As shown in FIG. 3, star shaped dimples of the present invention have an encompassing diameter, D1, and an interior diameter, D2. The encompassing diameter, D1, is preferably from 0.05 inches to 0.35 inches. The ratio, $$\frac{D1}{D2},$$

of the encompassing diameter, D1, to the interior diameter, D2, is preferably 2 or 3 or 4 or 5, or is within a range having a lower limit and an upper limit selected from these values. The plan shape area, $A_p$, as measured in a plane normal to the axis connecting the plan shape centroid and the ball centroid, is preferably from $6.0\times10^{-4}$ in$^2$ to 0.0350 in$^2$.

Figure 4:
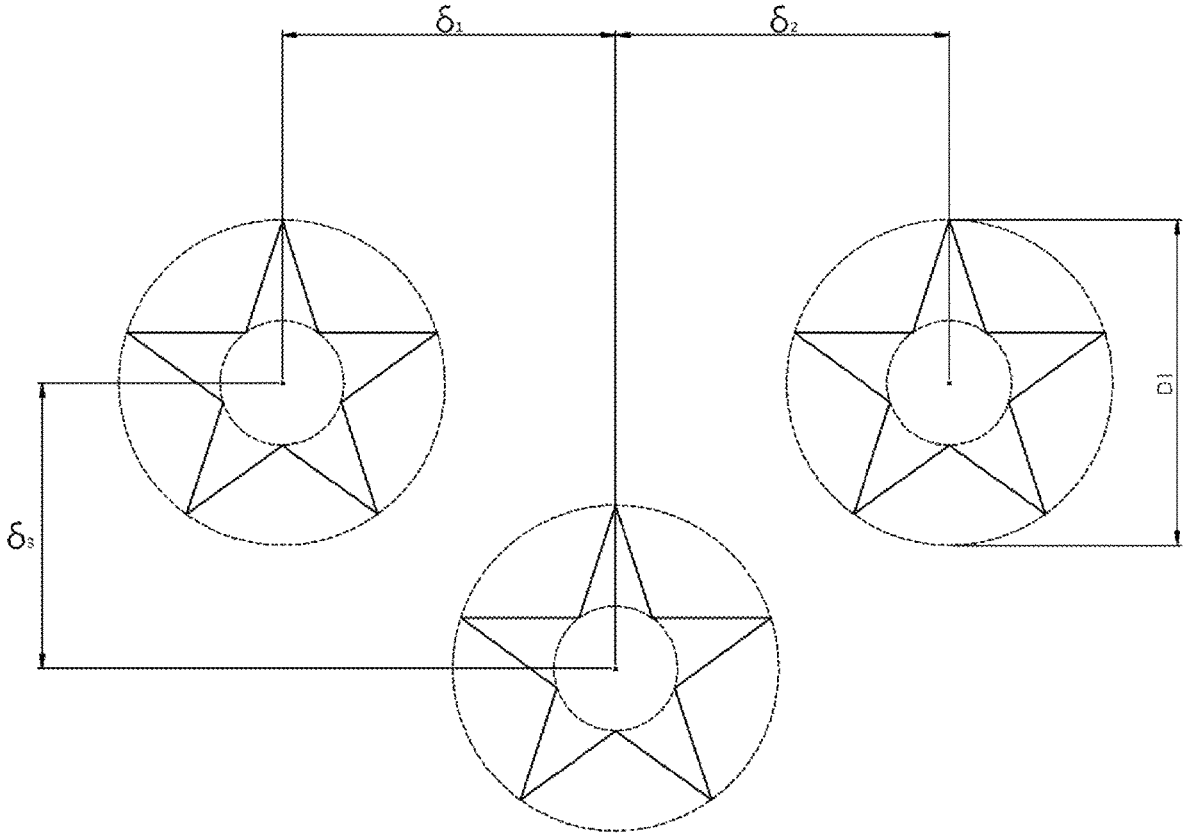
FIG. 4 illustrates a group of three stellated polygon shaped dimples according to an embodiment of the present invention.

In a particular embodiment, the dimple pattern of the present invention includes a group of at least three star shaped dimples arranged within relatively close proximity to each other, and preferably in a hexagonal manner, wherein, within the group of relatively closely spaced star shaped dimples, the centroid of at least one star shaped dimple does not lie in the same plane as two other star shaped dimples. For example, FIG. 4 shows a group of three star shaped dimples having the same encompassing diameter, D1, and separated by distances $\delta_1$, $\delta_2$, and $\delta_3$. The ratio, $$\frac{D1}{\delta 1},$$

of the encompassing diameter, D1, to distance $\delta_1$ is preferably 0.75 or 0.90 or 1.00 or 1.25, or is within a range having a lower limit and an upper limit selected from these values. The ratio, $$\frac{D1}{\delta 2},$$

of the encompassing diameter, D1, to distance $\delta_2$ is preferably 0.75 or 0.90 or 1.00 or 1.25, or is within a range having a lower limit and an upper limit selected from these values. The ratio, $$\frac{D1}{\delta 3},$$

of the encompassing diameter, D1, to distance $\delta_3$ is preferably 0.90 or 1.10 or 1.20 or 1.40, or is within a range having a lower limit and an upper limit selected from these values. Preferably, the difference between $\delta_1$ and $\delta_2$ is from 0 to 0.005 inches.

Figure 5A:
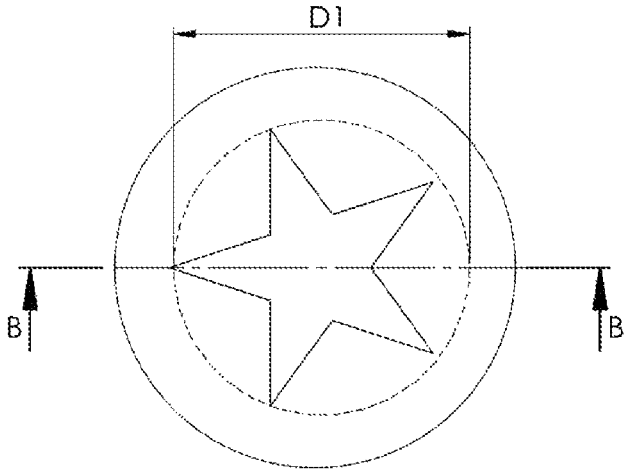
FIG. 5A illustrates a plan view of a stellated polygon shaped dimple according to an embodiment of the present invention.
Figure 5B:
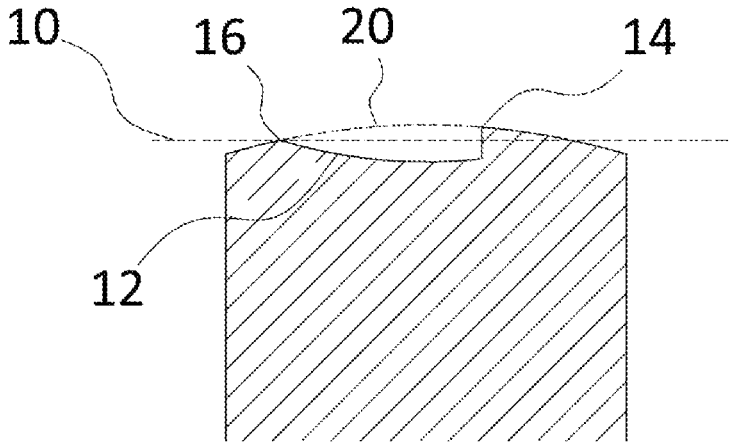
FIG. 5B is a profile view of the dimple of FIG. 5A taken along line B-B.

The profile of star shaped dimples of the present invention is preferably selected from arcuate (i.e., spherical), catenary, flat bottom, and constant depth profiles. An illustrative example of a star shaped dimple of the present invention having an arcuate dimple profile is shown in FIGS. 5A-5B. FIG. 5A shows a plan view of the dimple. FIG. 5B shows a profile view of the dimple of FIG. 5A taken along line B-B. All of the exterior vertices of the stellated polygon lie on the same encompassing diameter plane 10. The phantom ball surface 20 is the part of the ball surface that would exist if the dimple were not present. In the embodiment shown in FIGS. 5A-5B, the dimple profile 12 is defined by an arc having a starting point located at an exterior vertex 16 of the stellated polygon. Optionally, the arc starting point is offset from the dimple surface by a depth of up to 0.0050 inches. Also shown in FIG. 5B is the point 14 where an interior vertex of the stellated polygon connects to the ball surface. All of the interior vertices of the stellated polygon lie on the same interior diameter plane. Star shaped dimples of the present invention having an arcuate dimple profile preferably have an edge angle, as measured at the exterior vertices of the stellated polygon, of from 11.0° to 17.0°. Star shaped dimples of the present invention having an arcuate dimple profile preferably have a dimple depth, as measured along a ball radius from the phantom surface of the ball to the deepest point on the dimple, of from 0.005 inches to 0.025 inches.

Figure 6A:
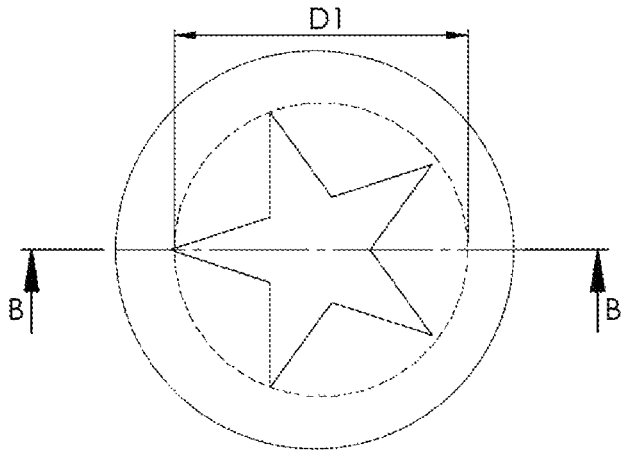
FIG. 6A illustrates a plan view of a stellated polygon shaped dimple according to another embodiment of the present invention.
Figure 6B:
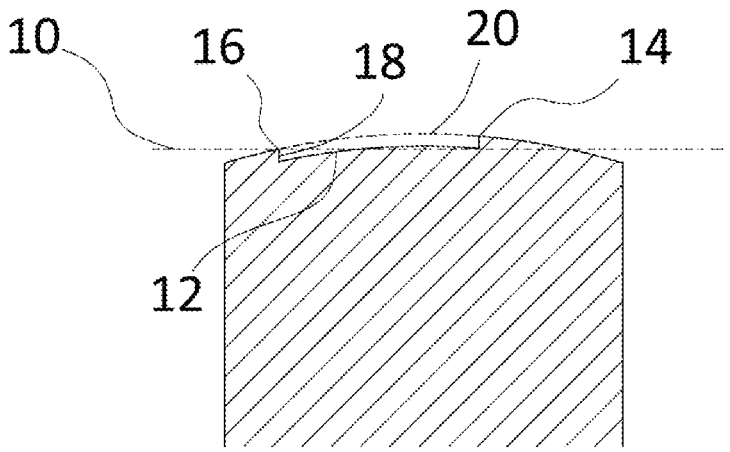
FIG. 6B is a profile view of the dimple of FIG. 6A taken along line B-B.

An illustrative example of a star shaped dimple of the present invention having a constant depth dimple profile is shown in FIGS. 6A-6B. FIG. 6A shows a plan view of the dimple. FIG. 6B shows a profile view of the dimple of FIG. 6A taken along line B-B. All of the exterior vertices of the stellated polygon lie on the same encompassing diameter plane 10. The phantom ball surface 20 is the part of the ball surface that would exist if the dimple were not present. In the embodiment shown in FIGS. 6A-6B, the dimple profile 12 is defined by an arc that is concentric with the dimple surface such that is creates a sidewall 18 at all points along the dimple perimeter. Star shaped dimples of the present invention having a constant depth dimple profile have a dimple depth, as measured along a ball radius from the phantom surface of the ball to the deepest point on the dimple, of from 0.003 inches to 0.015 inches.

Figure 7A:
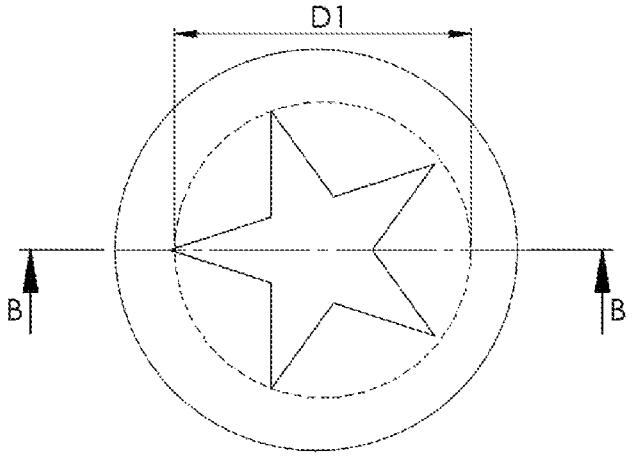
FIG. 7A illustrates a plan view of a stellated polygon shaped dimple according to another embodiment of the present invention.
Figure 7B:
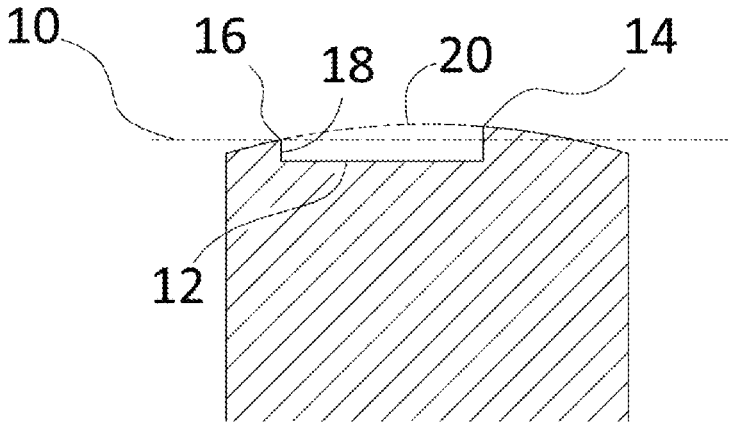
FIG. 7B is a profile view of the dimple of FIG. 7A taken along line B-B.

An illustrative example of a star shaped dimple of the present invention having a flat bottom dimple profile is shown in FIGS. 7A-7B. FIG. 7A shows a plan view of the dimple. FIG. 7B shows a profile view of the dimple of FIG. 7A taken along line B-B. All of the exterior vertices of the stellated polygon lie on the same encompassing diameter plane 10. The phantom ball surface 20 is the part of the ball surface that would exist if the dimple were not present. In the embodiment shown in FIGS. 7A-7B, the bottom of the dimple is flat, creating a sidewall 18 at all points along the dimple perimeter. In the embodiment shown in FIGS. 7A-7B, the bottom of the dimple is equidistant from the encompassing diameter plane 10 at all points. Star shaped dimples of the present invention having a flat bottom dimple profile have a dimple depth, as measured along a ball radius from the phantom surface of the ball to the deepest point on the dimple, of from 0.005 inches to 0.025 inches.

Figure 8:
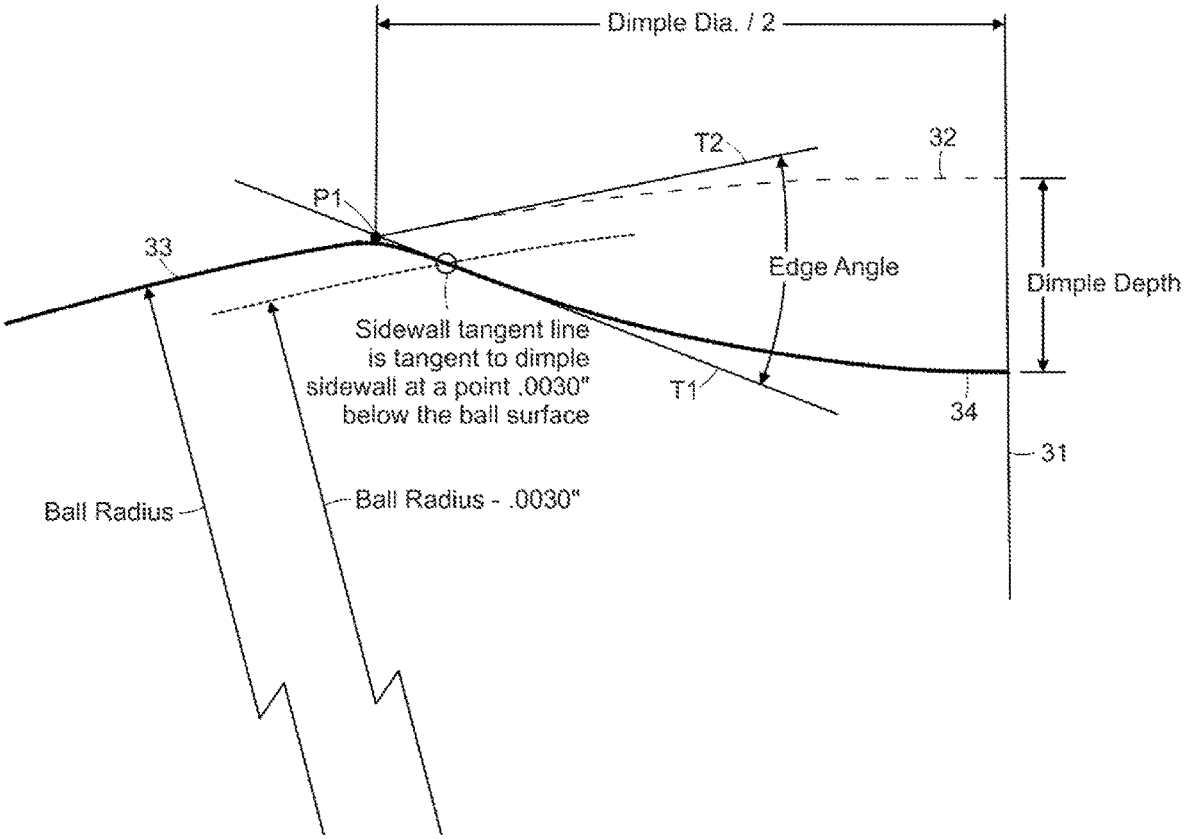
FIG. 8 is a schematic diagram illustrating a method for measuring the diameter of a dimple.

For purposes of the present disclosure, edge angle measurements are determined on finished golf balls. Generally, it may be difficult to measure an edge angle due to the indistinct nature of the boundary dividing the dimple from the ball's undisturbed land surface. Due to the effect of coatings on the golf ball surface and/or the dimple design itself, the junction between the land surface and the dimple is typically not a sharp corner and is therefore indistinct. This can make the measurement of properties such as edge angle ($\Phi_{EDGE}$) and dimple diameter, somewhat ambiguous. To resolve this problem, edge angle ($\Phi_{EDGE}$) on a finished golf ball is measured as follows, in reference to FIG. 8. FIG. 8 shows a dimple half-profile extending from the dimple centerline 31 to the ball's undisturbed land surface 33. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle ($\Phi_{EDGE}$) is the angle between T1 and T2.

Grooves

Dimple patterns of the present invention include grooves, preferably resembling stripes on the American flag. The profile of grooves of the present invention is preferably selected from arcuate, flat bottom, and constant depth profiles. Suitable profile shapes for grooves of the present invention include those disclosed in U.S. Pat. No. 9,707,451, the entire disclosure of which is hereby incorporated herein by reference. Preferably, the depth of the grooves is from 0.001 inches to 0.020 inches, as measured along a ball radius from the phantom surface of the ball to the deepest point of the groove. Preferably, the width of the grooves is from 0.05 inches to 0.35 inches. The width of a single groove can be constant along the length of the groove, or the width of a single groove can vary by up to 0.15 inches along the length of the groove. The plan shape of the grooves of the present invention can be defined by a straight line or a curved path. In a particular embodiment, each groove is separated by land area that is about the same width as, i.e., within 25% of, the width of the grooves adjacent to it.

In a particular embodiment, at least one groove terminates at the parting line of the golf ball at both ends of the groove.

Each groove has two long edges that meet the fret surface of the golf ball. In a particular embodiment, the maximum groove length on the ball, as measured by the groove edge with the longest length, is 2.00 inches or greater.

Non-Limiting Illustrative Dimple Patterns

In one embodiment, the outer surface of the ball is divided by a plane that passes through the geometric center of the golf ball and divides the outer surface into a first hemisphere and a second hemisphere, wherein the first hemisphere has an arrangement of star shaped dimples and/or grooves, the second hemisphere has an arrangement of star shaped dimples and/or grooves, and the arrangement of star shaped dimples and/or grooves on the first hemisphere is different from that on the second hemisphere.

In a particular aspect of this embodiment, the first hemisphere comprises star shaped dimples in an amount of at least 40, or from 40 to 60. In a more particular aspect of this embodiment, the first hemisphere comprises 50 star shaped dimples. The first hemisphere optionally includes one or more dimples having a conventional plan shape, e.g., a circular plan shape, in addition to the star shaped dimples.

In another particular aspect of this embodiment, the second hemisphere comprises grooves in an amount of at least 5, or from 5 to 10. In a more particular aspect of this embodiment, the second hemisphere comprises 6 grooves. The second hemisphere optionally includes one or more dimples having a conventional plan shape, e.g., a circular plan shape, in addition to the grooves.

Referring now to FIGS. 1A-1C, a golf ball outer surface is illustrated having a first hemisphere consisting of 50 star shaped dimples and a second hemisphere consisting of 6 grooves, the grooves being represented by shading in FIG. 1C. Each of the star shaped dimples of the first hemisphere has a plan shape defined by a stellated pentagon, an encompassing diameter of 0.240 inches, and a plan shape area of 0.016 $in^2$. Each of the star shaped dimples of the first hemisphere has an arcuate profile shape, an edge angle of 16.0° at the exterior vertices of the stellated pentagon, and a dimple depth, as measured along a ball radius from the phantom surface of the ball to the deepest point on the dimple, of 0.0168 inches. Each of the grooves of the second hemisphere has a plan shape defined by a curved path, and are separated from each other by land area that is similar in width to the grooves. The width of each groove varies along the length of the groove. In a further particular aspect of the embodiment shown in FIGS. 1A-1C, the grooves of the second hemisphere have properties as given in Table 1 below.

TABLE 1

| Groove | Profile Shape | Depth (in) | Max Width (in) | Min Width (in) | First Edge Length (in) | Second Edge Length (in) |
|---|---|---|---|---|---|---|
| 1 | constant depth | 0.012 | 0.260 | 0.123 | 1.69 | 2.10 |
| 2 | constant depth | 0.012 | 0.156 | 0.125 | 2.36 | 2.54 |
| 3 | constant depth | 0.012 | 0.133 | 0.127 | 2.65 | 2.69 |
| 4 | constant depth | 0.012 | 0.134 | 0.129 | 2.68 | 2.60 |
| 5 | constant depth | 0.012 | 0.205 | 0.122 | 2.44 | 2.18 |
| 6 | constant depth | 0.012 | 0.240 | 0.145 | 1.81 | 1.36 |

In another embodiment, the outer surface of the ball is divided by a plane that passes through the geometric center of the golf ball and divides the outer surface into a first hemisphere and a second hemisphere, wherein the first hemisphere has an arrangement of star shaped dimples and grooves, and the second hemisphere has an arrangement of dimples and grooves that is substantially identical to the arrangement of the first hemisphere.

In a particular aspect of this embodiment, each hemisphere comprises star shaped dimples in an amount of at least 40, or from 40 to 60. In a more particular aspect of this embodiment, each hemisphere comprises 50 star shaped dimples.

Each hemisphere optionally includes one or more dimples having a conventional plan shape, e.g., a circular plan shape, in addition to the star shaped dimples. In a particular aspect of this embodiment, each hemisphere comprises at least 25, or at least 50, or at least 60, dimples having a conventional, e.g., circular, plan shape.

In another particular aspect of this embodiment, each hemisphere comprises grooves in an amount of at least 5, or from 5 to 10. In a more particular aspect of this embodiment, each hemisphere comprises 6 grooves.

Referring now to FIGS. 2A-2C, a golf ball outer surface is illustrated having substantially identical hemispheres, each of which consists of 50 star shaped dimples, 70 spherical dimples, and 6 grooves, the grooves being represented by shading in FIGS. 2B-2C. Each of the star shaped dimples has a plan shape defined by a stellated pentagon, an encompassing diameter of 0.080 inches, and a plan shape area of 0.0018 $in^2$. Each of the star shaped dimples has a flat bottom profile shape and a dimple depth, as measured along a ball radius from the phantom surface of the ball to the deepest point on the dimple, of 0.0042 inches. The spherical dimples have an edge angle of 14.75° and include dimples having the following dimple diameters: 0.110 inches, 0.130 inches, 0.150 inches, 0.160 inches, 0.170 inches, and 0.185 inches. Each of the grooves has a plan shape defined by a curved path, and are separated from each other by land area that is similar in width to the grooves. The width of each groove varies along the length of the groove. In a further particular aspect of the embodiment shown in FIGS. 2A-2C, the grooves of the second hemisphere have properties as given in Table 2 below.

TABLE 2

| Groove | Profile Shape | Depth (in) | Max Width (in) | Min Width (in) | First Edge Length (in) | Second Edge Length (in) |
|---|---|---|---|---|---|---|
| 1 | constant depth | 0.010 | 0.078 | 0.075 | 1.40 | 1.47 |
| 2 | constant depth | 0.010 | 0.078 | 0.076 | 1.52 | 1.56 |
| 3 | constant depth | 0.010 | 0.078 | 0.076 | 1.59 | 1.61 |
| 4 | constant depth | 0.010 | 0.078 | 0.076 | 2.69 | 2.66 |
| 5 | constant depth | 0.010 | 0.078 | 0.076 | 2.62 | 2.55 |
| 6 | constant depth | 0.010 | 0.078 | 0.076 | 2.46 | 2.36 |

Golf balls of the present invention may have a flat parting line or a non-flat parting line.

Golf ball dimple patterns of the present invention may include conventional dimples, including, but not limited to, spherical dimples, catenary dimples, and the like, in addition to stellated polygon shaped dimples.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of dimples and a plurality of grooves on the outer surface thereof, wherein the outer surface can be divided by a dividing plane that passes through the geometric center of the golf ball and divides the outer surface into a first hemisphere and a second hemisphere having the following properties:

the first hemisphere comprises at least 40 dimples having a stellated polygon plan shape and does not include any grooves, and the second hemisphere comprises at least 5 grooves and does not include any dimples having a stellated polygon plan shape.

2. The golf ball of claim 1, wherein the first hemisphere comprises at least 50 dimples having a stellated polygon plan shape.

3. The golf ball of claim 1, wherein the first hemisphere consists essentially of 50 dimples having a stellated polygon plan shape.

4. The golf ball of claim 1, wherein the second hemisphere comprises at least 6 grooves.

5. The golf ball of claim 1, wherein the second hemisphere consists essentially of 6 grooves.

6. The golf ball of claim 1, wherein each of the grooves has a plan shape defined by a curved path.

7. The golf ball of claim 1, wherein each of the grooves has two ends, and wherein at least one of the grooves terminates at both ends at the dividing plane.

8. The golf ball of claim 1, wherein each of the dimples having a stellated polygon plan shape has an encompassing diameter of from 0.20 inches to 0.35 inches.

9. The golf ball of claim 1, wherein each of the dimples having a stellated polygon plan shape has a ratio, $$\frac{D1}{D2},$$

of the encompassing diameter, D1, to the interior diameter, D2, of from 2 to 5.

10. The golf ball of claim 1, wherein each of the dimples having a stellated polygon plan shape has a ratio, $$\frac{D1}{D2},$$

of the encompassing diameter, D1, to the interior diameter, D2, of from 2 to 3.

11. The golf ball of claim 1, wherein each of the grooves has a depth of from 0.007 inches to 0.017 inches, as measured along a ball radius from the phantom surface of the ball to the deepest point of the groove.

12. A golf ball having a plurality of dimples and a plurality of grooves on the outer surface thereof, wherein the outer surface can be divided by a dividing plane that passes through the geometric center of the golf ball and divides the outer surface into a first hemisphere and a second hemisphere having the following properties:

the first hemisphere has an arrangement of dimples and grooves comprising 50 dimples having a stellated polygon plan shape and 6 grooves, wherein the dimples and grooves do not overlap or touch, and the second hemisphere has an arrangement of dimples and grooves that is substantially identical to the arrangement of the first hemisphere.

13. The golf ball of claim 12, wherein the arrangement of dimples and grooves of each hemisphere additionally comprises a plurality of dimples having a circular plan shape.

14. The golf ball of claim 13, wherein each hemisphere includes at least 50 dimples having a circular plan shape.

15. The golf ball of claim 12, wherein the arrangement of dimples and grooves of each hemisphere consists essentially of 50 dimples having a stellated polygon plan shape and 6 grooves.

16. The golf ball of claim 12, wherein each of the grooves has a plan shape defined by a curved path.

17. The golf ball of claim 12, wherein each of the dimples having a stellated polygon plan shape has an encompassing diameter of from 0.05 inches to 0.15 inches.

18. The golf ball of claim 12, wherein each of the dimples having a stellated polygon plan shape has a ratio, $$\frac{D1}{D2},$$

of the encompassing ammeter, D1, to the interior diameter, D2, of from 2 to 5.

19. The golf ball of claim 12, wherein each of the dimples having a stellated polygon plan shape has a ratio, $$\frac{D1}{D2},$$

of the encompassing ammeter, D1, to the interior diameter, D2, of from 2 to 3.

20. The golf ball of claim 12, wherein each of the grooves has a depth of 0.005 inches to 0.015 inches, as measured along a ball radius from the phantom surface of the ball to the deepest point of the groove.

* * * * *